US011873136B2

(12) United States Patent
Lapelosa

(10) Patent No.: US 11,873,136 B2
(45) Date of Patent: Jan. 16, 2024

(54) EASY-GRIP HANDLE FOR A PORTABLE CONTAINER

(71) Applicant: NITTY-GRITTY SRL, Sassuolo (IT)

(72) Inventor: Marco Lapelosa, Marano sul Panaro (IT)

(73) Assignee: NITTY GRITTY SRL, Sassuolo (IT)

( * ) Notice: Subject to any disclaimer, the term of this patent is extended or adjusted under 35 U.S.C. 154(b) by 173 days.

(21) Appl. No.: 17/053,956

(22) PCT Filed: May 7, 2019

(86) PCT No.: PCT/IT2019/050093
§ 371 (c)(1),
(2) Date: Nov. 9, 2020

(87) PCT Pub. No.: WO2019/215771
PCT Pub. Date: Nov. 14, 2019

(65) Prior Publication Data

US 2021/0221565 A1 Jul. 22, 2021

(30) Foreign Application Priority Data

May 7, 2018 (IT) ..... 102018000005128

(51) Int. Cl.
*B65D 25/32* (2006.01)

(52) U.S. Cl.
CPC ..... *B65D 25/32* (2013.01); *B65D 2313/04* (2013.01)

(58) Field of Classification Search
CPC ..... B65D 43/24; B65D 2525/286; B65D 2525/288; B65D 25/32; E05B 15/0073; E05B 2015/0695; A47J 47/18
(Continued)

(56) References Cited

U.S. PATENT DOCUMENTS 487,688 A * 12/1892 Bingham ..... B65D 25/32 220/768
2,908,468 A * 10/1959 Thomas ..... E06C 7/14 220/756

(Continued)

FOREIGN PATENT DOCUMENTS

CN 203078907 7/2013
CN 105173323 12/2015

(Continued)

OTHER PUBLICATIONS

International Search Report dated Aug. 23, 2019 in International Application No. PCT/PT2019/050093.

(Continued)

*Primary Examiner* — Mollie Impink
(74) *Attorney, Agent, or Firm* — Stephen J. Weyer, Esq.; Stites & Harbison, PLLC

(57) ABSTRACT

An easy grip handle for a portable container comprises a handle connected with a hinge and rotating on the side of the container itself to define lying positions and at least one raised position with respect to the same container; and has the handle maintained, at least in a raised position or in an almost vertical position, by at least one permanent magnet acting on the rotation of the handle, close to the rotation hinge, in combination with at least one ferromagnetic element positioned in the handle or in the container to define, by magnetic attraction when facing the permanent magnet, at least one said raised or almost vertical position of the handle on the portable container itself. Different constructive forms are described with various arrangements of the permanent magnet elements and corresponding ferromagnetic elements.

8 Claims, 8 Drawing Sheets

(58) Field of Classification Search
USPC ..... 220/762–764, 773
See application file for complete search history.

(56) References Cited

U.S. PATENT DOCUMENTS

| | | | | |
|---|---|---|---|---|
| 5,787,839 | A | 8/1998 | Magnant et al. | |
| 6,062,389 | A * | 5/2000 | Kent | B44D 3/12 220/555 |
| 6,408,484 | B1 * | 6/2002 | Vandertouw | E05F 1/00 16/374 |
| 6,831,541 | B1 * | 12/2004 | Seidler | H01F 7/0263 206/818 |
| 2009/0064402 | A1 | 3/2009 | Mauduit | |
| 2012/0080891 | A1 * | 4/2012 | Bravo | E05C 17/443 292/251.5 |
| 2016/0001932 | A1 * | 1/2016 | Chourreau | E05D 7/1011 220/829 |

FOREIGN PATENT DOCUMENTS

| | | | | |
|---|---|---|---|---|
| DE | 202017004333 | | 9/2017 | |
| NL | 8200147 | A * | 6/1982 | B65D 25/32 |

OTHER PUBLICATIONS

Written Opinion dated Aug. 23, 2019 in International Application No. PCT/IT2019/050093.

* cited by examiner

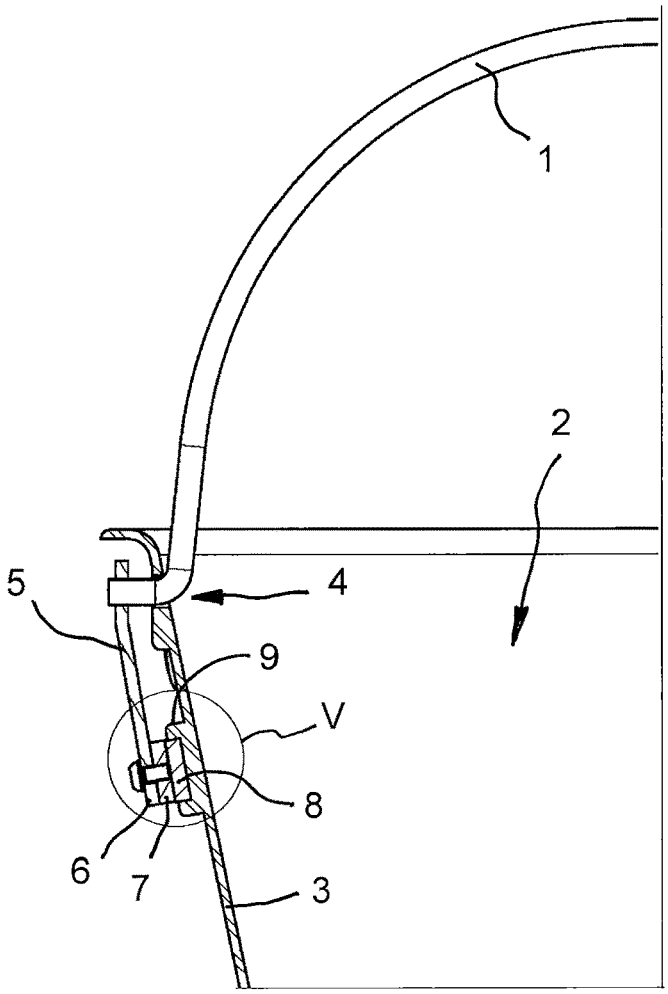
Fig. 4
Fig. 5
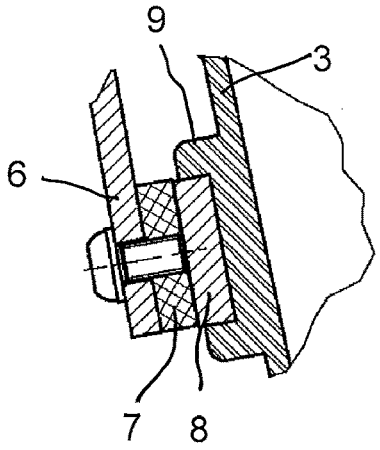
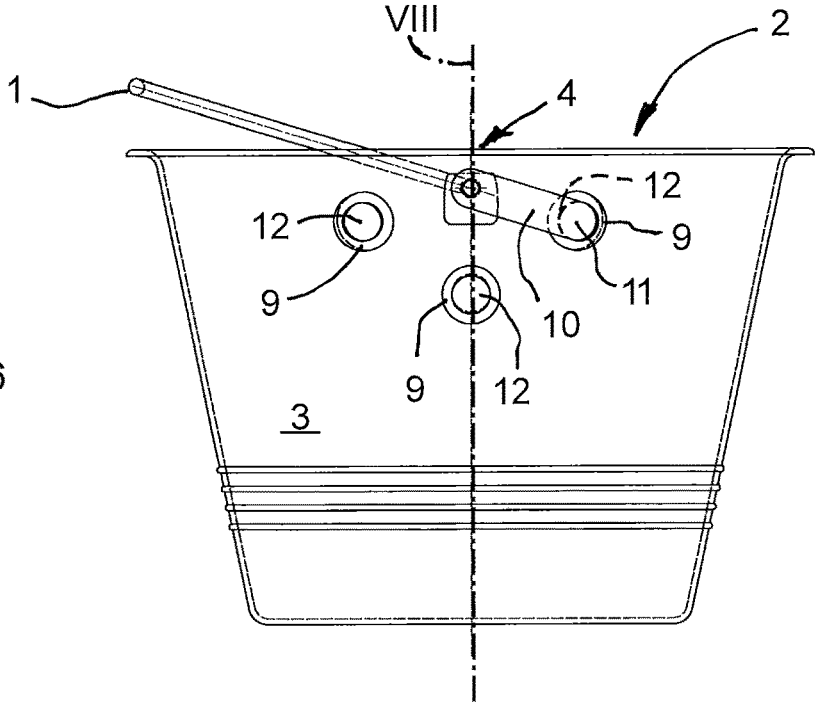
Fig. 6

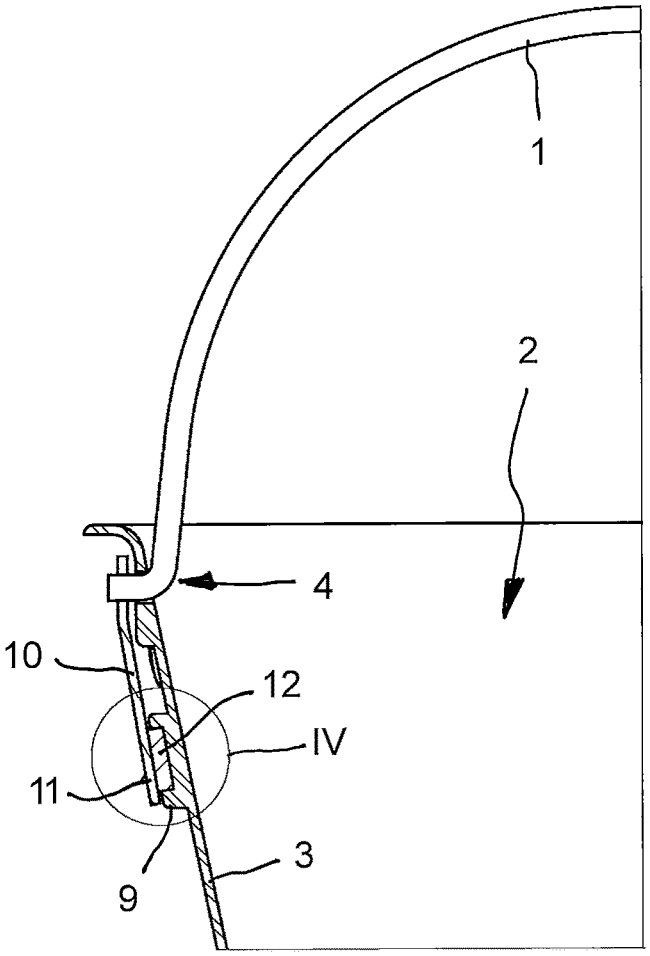
Fig. 8
Fig. 9
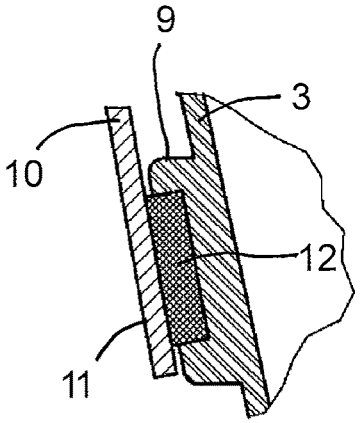
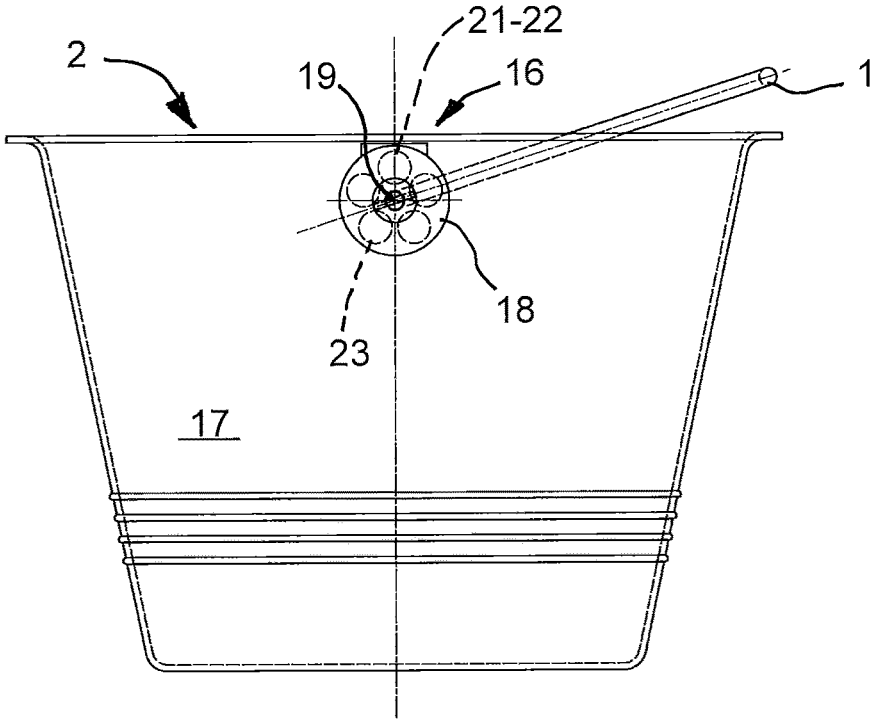
Fig. 10

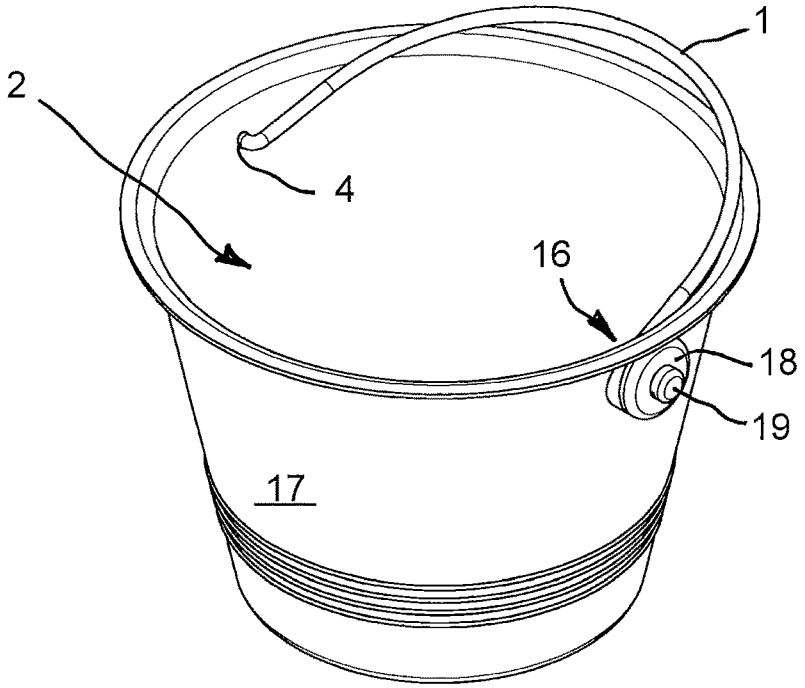
Fig. 11
Fig. 12
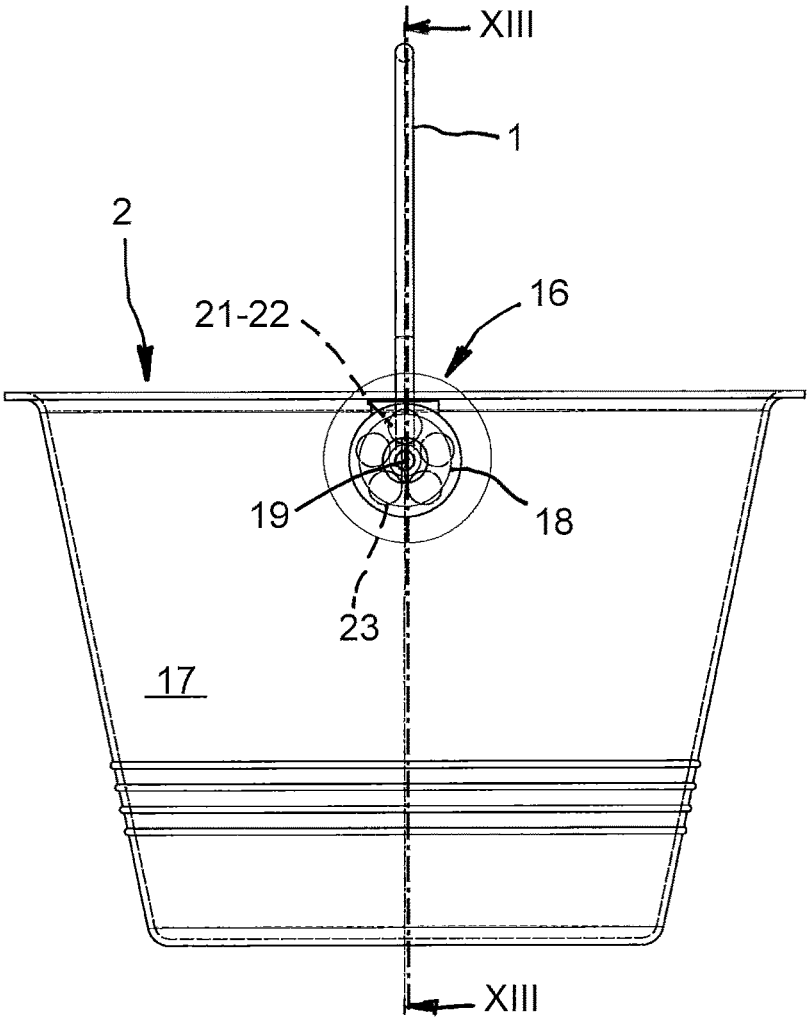

EASY-GRIP HANDLE FOR A PORTABLE CONTAINER

FIELD OF APPLICATION

The present invention relates to portable containers, be they open or closed, in which an easy grip handle is made, that is to say containers which are usually transported by the user such as boxes, closed or open cases and also bins, cans or buckets, fitted with a cover or without it, i.e. like a normal bucket used by construction workers who prepare mixtures of mortar or cement, such as bricklayers, or glues for fixing or mounting planar elements, such as floor ceramic tile or coating fitters or any other function, such as the transport of loose materials by hand or of liquid materials, the bucket being involved having a handle that is pivoted on two opposite points of the side of the same bucket. The portable container, therefore, whether it is a mason's bucket as said, a box or a toolbox, a paint or wall paint bin or can, herein discloses an easy grip handle for the user who uses it.

BACKGROUND ART

The state of the art includes transportable containers which have handles for their handling which, being pivoted at the ends of the arched handle to the side of the container itself, can have reclined positions on one side or on the opposite side due to the force of gravity, or have intermediate positions for easy handling by the user/operator who uses it.

In the art, a box for objects is known from document CN203078907U on whose opposite sides two arched handles are connected in rotation, which can be reclined in a horizontal position or joined in a vertical position and held in said position by an insertion fork; this fork making it possible to prevent the displacement from the vertical position of one of the two arched handles without removing the said fork from its seat. The fork is associated to a permanent magnet which, due to the magnetic attraction of the arched handles on the ferromagnetic material, keeps it firmly anchored to the same arched handles, placed in a vertical position and juxtaposed to each other, thus preventing their detachment.

In fact, the main limitation of the solution described in this document lies in the necessarily double conformation of the arched handles and in the fact that each can perform a rotation about its own axis compatibly with the simultaneous rotation that is not an obstacle to the other handle. Moreover, the fixed position of both handles remains defined by the correspondence of the position of the holes for the insertion fork retained in the locking action by the permanent magnet.

In the art, a paint can or bin is known from document CN105173323A, equipped with a lid and eyelets for hooking the side to side or upper supports on the lid. Furthermore, the can is equipped with an arched handle connected in rotation on the opposite sides of the bin. The handle can be kept in a vertical position, by means of a ball-type locking device subjected to the action of a spring present at the rotation pin of the arched handle on the side of the can, or in an approximately horizontal position for the attraction of an associated permanent magnet and close to the grip handle at the centre of the arched handle which, when placed at the metallic ferromagnetic steel plate side of the bin, holds the arched handle in a reclined, approximately horizontal position.

In fact, the main limit of the solution, in the prior document described therein, lies in the conformation of the vertical positioning of the arched handle, and in which the ball-type locking device defines the vertical position of the arched handle, that is with the use of mechanical locks in the vicinity of the rotation pin of the arched handle.

In the prior art there are no open containers such as mason's buckets or even closed containers which have the usual arched handle equipped with rotation locking devices, between the extreme positions of lying reclined to the right or left of the bucket/container mouth or even in determining almost vertical intermediate positions for positioning the arched handle.

Moreover, what has been described in the previous documents is difficult to apply because the action of maintaining the arched handle vertically or in an almost vertical position requires mechanisms which are impractical to use or which require the intervention of the operator with two hands to change its position.

This state of the art is susceptible of considerable improvements with regard to the possibility of realizing a portable container in which an easy grip handle is made, which overcomes the aforementioned limits of the known art.

Therefore, the technical problem that underlies the present invention is to produce a portable container in which an easy grip handle is made, which makes gripping easier for the user/operator, who often, intent on his work, vaguely remembers where he placed the container and tries to grip the handle on the container in order to move it without even looking at it.

An object inherent in the preceding technical problem is that of realizing a new way of maintaining in a different position from the lying position on one side of the edge of the container, be it a bin, can, bucket, box or case, avoiding mechanisms that can jam during activation, especially when the used products can damage or dirty the container itself and its side in use.

A further and not last object of the present invention is to provide a reclining arched handle for a container, be it a bin, can, bucket, box or case, allowing the arched handle to be positioned also in intermediate positions, in addition to the three classic positions: central and almost vertical, lateral resting on the edge of the container on one side or on the opposite side, also allowing for intermediate inclination positions.

SUMMARY OF THE INVENTION

This problem is solved, according to the present invention, by a handle connected with a hinge and rotating on the side of the container itself in order to define lying positions and at least one position raised with respect to the container itself; characterized in that the handle is maintained, at least in a raised position or in an almost vertical position, by at least one permanent magnet acting on the rotation of the handle, close to the rotation hinge, in combination with at least one ferromagnetic element positioned in the handle or in the container to define, by magnetic attraction when facing the permanent magnet, at least one of said raised or almost vertical position of the handle on the portable container itself.

In a further constructive form the permanent magnet is positioned at one end of a positioning arm fitted and rotating with the same easy grip handle; one or more ferromagnetic elements are stably inserted on the side of the portable container to define, through the magnetic interaction, the raised and/or almost vertical position(s) of the handle on the portable container.

Moreover, in an improved constructive form, the ferromagnetic element is made with a positioning arm fitted and rotating with the handle having an easier grip; one or more permanent magnet elements are stably inserted on the side of the portable container to define, through the magnetic interaction, the raised and/or almost vertical position(s) of the handle on the portable container.

Furthermore, in a specific and preferred embodiment, there is at least one permanent magnet element which is stably inserted on the side of the portable container, close to the rotation hinge of the handle and facing a positioning flange fitted and rotating with the same easy grip handle; one or more ferromagnetic elements are inserted in the rotating positioning flange, to define, through the magnetic interaction, the raised and/or almost vertical position(s) of the handle on the portable container.

Moreover, in a further constructive form variant, there are more permanent magnet elements and correspondingly several ferromagnetic elements are present.

Furthermore, in a specific improved embodiment there are more permanent magnet elements and correspondingly there are more ferromagnetic elements equal in number to the permanent magnet elements plus two ferromagnetic elements.

Moreover, in a further advantageous constructive form, the mounting position between permanent magnet and ferromagnetic elements is reversed, as is the corresponding number of permanent magnet or ferromagnetic elements in the specific assembly.

Furthermore, in a constructive form variant, there are several permanent magnet elements arranged on a single magnetized toroidal element with sections of different polarity in the hinge of the easy grip handle, housed on a flange fitted on it and rotating therewith or on one side of the portable container; several ferromagnetic elements equal in number to the sections of the permanent magnet toroidal element face it to define, through the magnetic interaction, the raised and/or almost vertical position(s) of the handle on the portable container.

Finally, the embodiment of a portable container, equipped with an easy grip handle, wherein the easy grip handle is made according to one of the described constructive forms.

Further features and the advantages of the present invention, in the realization of a portable container in which an easy grip handle is made, will be apparent from the description, made below, of constructive forms and embodiments given by way of indicative and non-limiting example with reference to the eight attached drawings.

BRIEF DESCRIPTION OF THE DRAWINGS

FIG. 4 represents a schematic section IV of FIG. 1 in cross-section in the mason's bucket showing the first constructive form of an easy grip handle for a portable container of the invention;

FIG. 5 shows an enlarged schematic sectional view V of FIG. 4 and limited to the magnet and to the positioning arm connected to the arched handle and to the ferromagnetic element inserted in the side of the container;

FIG. 6 is a schematic side view of a second constructive version of an easy grip handle for a portable container, also in this case a mason's bucket, with the arrangement of three permanent magnets on the side of the bucket (portable container) and of a positioning arm connected to the arched handle and rotating with it;

FIG. 8 represents a schematic section VIII of FIG. 6 in cross section of the portable container with the easy grip and arched handle in an almost vertical position;

FIG. 9 shows an enlarged schematic sectional view IX of FIG. 8 limited to a single magnet, inserted in the side of the portable container, and to the positioning arm connected to and rotating with the arched handle;

FIG. 10 is a schematic side view of a third constructive form of an easy grip handle for a portable container according to the invention, here applied to a mason's bucket, with the arrangement of magnets inserted in a positioning flange connected to the arched handle and rotating with it or also in a radial surface facing the flange and present in the side of the portable container;

FIG. 11 represents a perspective and schematic view of the portable container of FIG. 10 with the easy grip and arched handle lying on one side of the upper edge of the container, shown here as a mason's bucket;

FIG. 12 represents a schematic side view with the easy grip and arched handle of the portable container of FIG. 11 in an almost vertical position;

DETAILED DESCRIPTION OF SOME PREFERRED EMBODIMENTS

Figure 1:
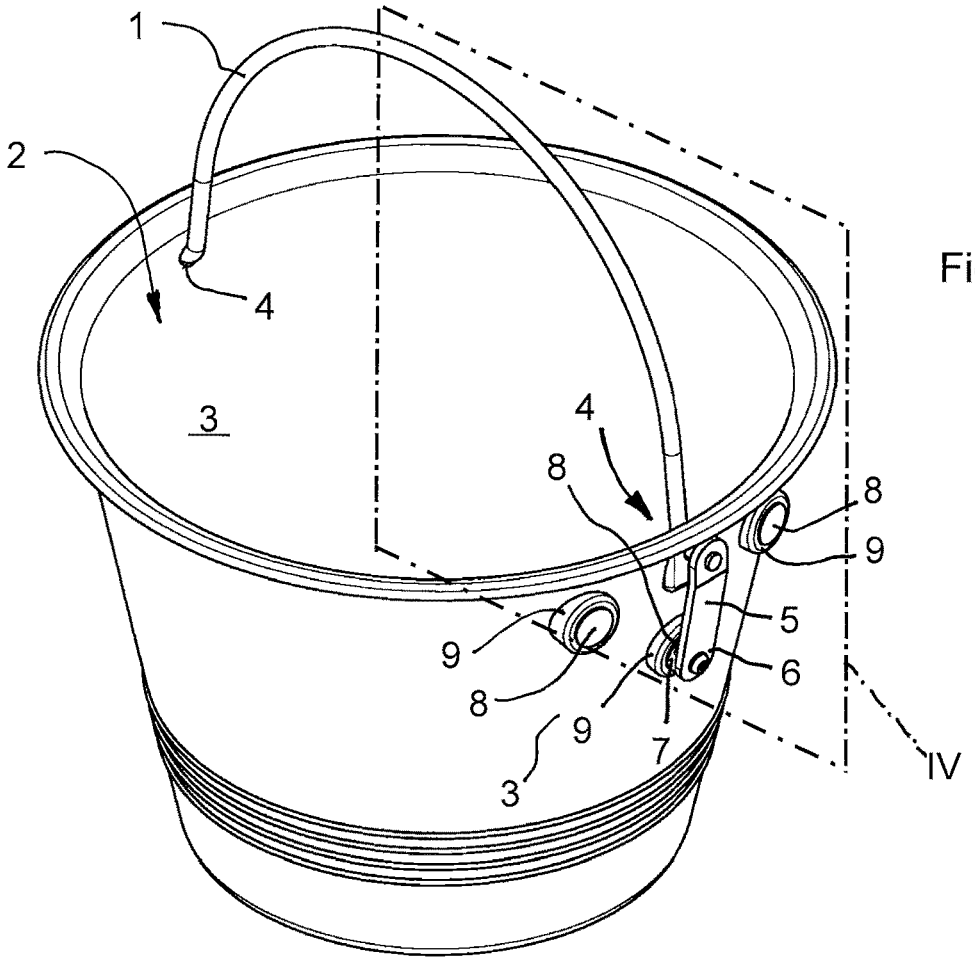
FIG. 1 represents a perspective and schematic view of a portable container in which an easy grip handle according to the invention is made, shown here in a mason's bucket according to a first constructive form of an easy grip arched handle and with the arched handle placed in the almost vertical position: it has the arrangement of a permanent magnet on a positioning arm connected to the arched handle, close to the pivot thereof, and of ferromagnetic elements positioned on the side of the container/bucket to delimit, in the rotations of the handle, the positions defined by the arched handle in the construction of the container.
Figure 2:
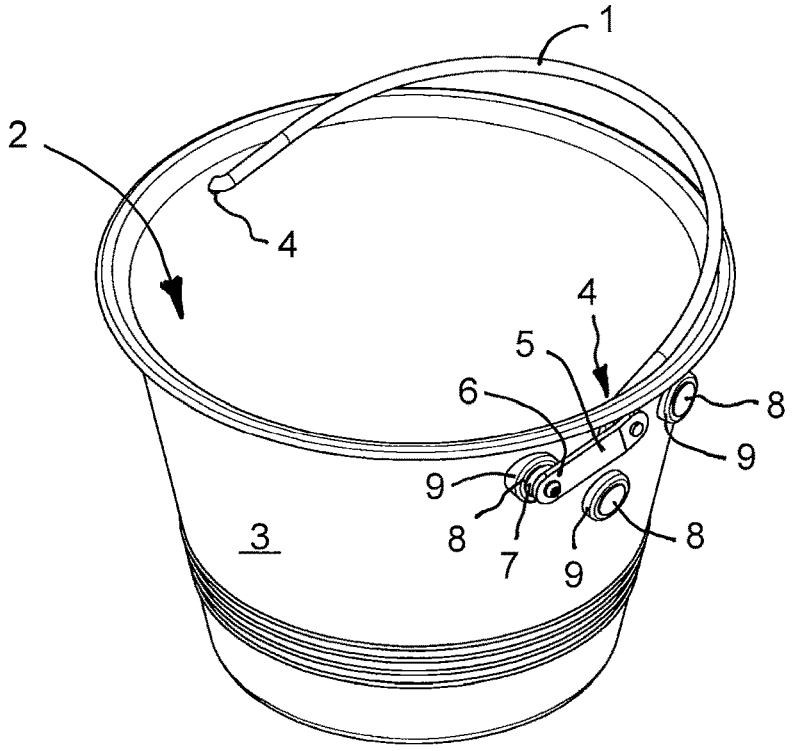
FIG. 2 represents a perspective and schematic view of the mason's bucket of FIG. 1 in which the arched easy grip handle lies on one side of the upper edge of the bucket and the positioning mechanism of the arched handle is correspondingly rotated.
Figure 3:
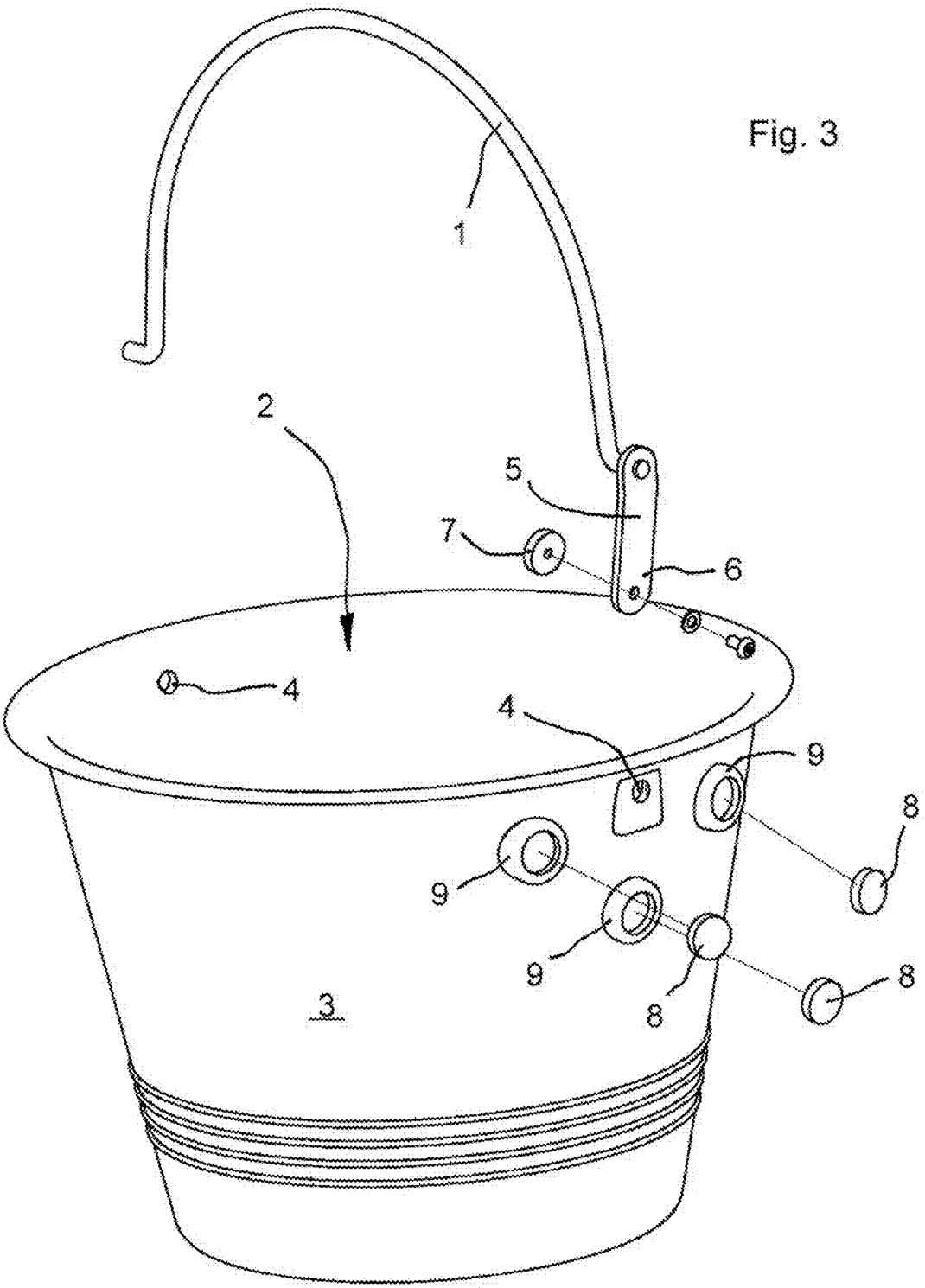
FIG. 3 shows an exploded perspective view showing the components of the easy grip handle according to the invention, with the first embodiment in the mason's bucket of FIG. 1.

In FIGS. 1 to 5 the first constructive form of an arched easy grip handle 1 according to the invention on a container 2 for loose or liquid materials, i.e. like a mason's bucket visible in the figures. The easy grip and arched handle is hinged on the sides 3 of the container 2 in opposite positions, diametrically opposed in the case of circular shapes such as the bucket shown. Close to at least one of the hinges 4 of the arched handle, a positioning means, shown here as a positioning arm 5 rotating with the same easy grip and arched handle, is fitted to the handle pin. At the end 6 of the positioning arm 5 a permanent magnet 7 is connected which, with the rotation of the arched handle and positioning arm assembly, makes a rotation, so as to reach a position opposite to the reclined position of the easy grip and arched handle on the side; correspondingly in the position in which the arched handle is almost vertical with respect to the container 2, a ferromagnetic element 8 is housed in the side 3 of the container. The magnetic attraction between the permanent magnet 7 and the ferromagnetic element 8 keeps the arched handle 1 in a fixed position, whether it is an almost vertical position, FIG. 1, or a reclined position, FIG. 2. The ferromagnetic element 8 is contained in a specific seat made in the construction of the side 3 of the container.

The mason's bucket depicted as a portable container on which the easy grip arched handle is applied is generally made of a plastic material, therefore the ferromagnetic elements 8 are inserted in raised seats 9 projecting on the side 3 of the portable container.

Figure 7:
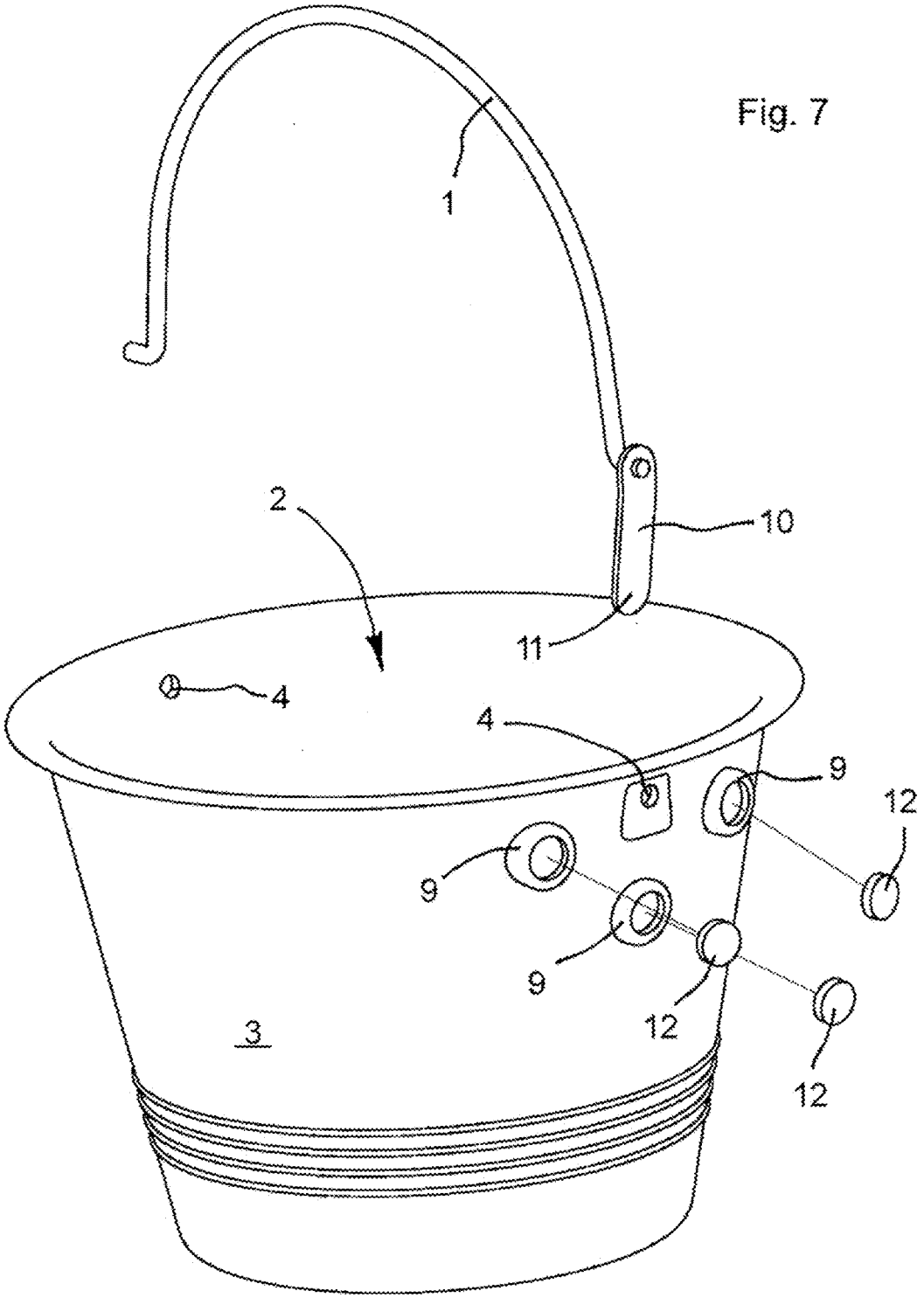
FIG. 7 shows an exploded perspective and schematic view showing the components of the second constructive form of an easy grip and arched handle on the portable container of FIG. 6.

A second constructive form of an easy grip handle mounted on a portable container is shown in FIGS. 6 to 9, in which like parts have like numerals with respect to the preceding Figures. The easy grip and arched handle 1 is connected and rotates in the hinges 3 of the portable container 2 together with a positioning means made here with a positioning arm 10 made of ferromagnetic material. The end 11 of the positioning arm 10 is subject to the attraction of a permanent magnet 12 which, when the rotation of the arched handle assembly and positioning arm, determines the proximity to a respective permanent magnet 12, in a position opposite to the reclined position of the easy grip and arched handle on the side or, correspondingly, in the position in which the arched handle is almost vertical with respect to the container 2. A permanent magnet 12 is housed in each raised seat 9 in the side 3 of the container. The magnetic attraction between the permanent magnet 12 and the end 11 of the ferromagnetic positioning arm 10, when facing the magnet, maintains the easy grip and arched handle 1 in a fixed position, whether it is in an almost vertical position or also in a position. reclined on one side or on the opposite side at the position of the raised seats 9 in the side 3 of the portable container 2.

Figure 13:
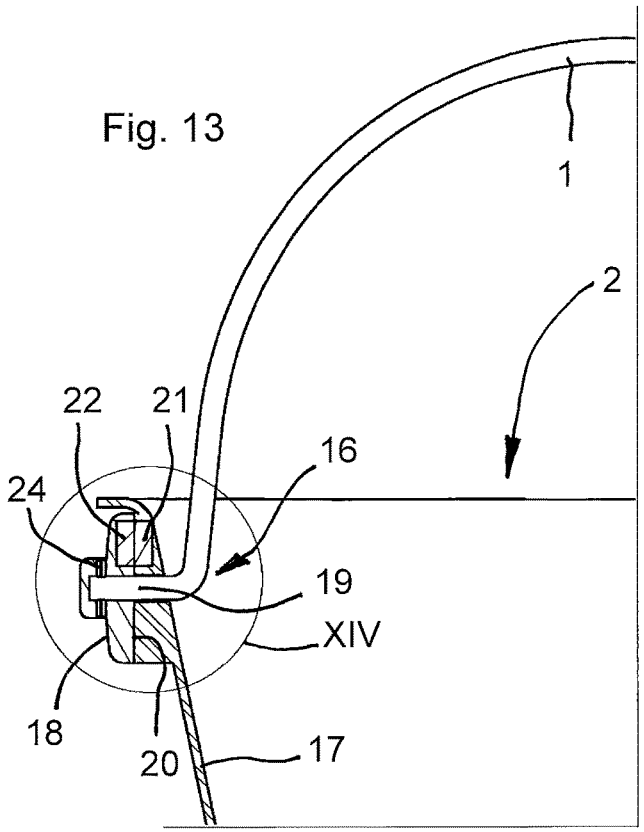
FIG. 13 represents a limited cross-sectional schematic section XIII-XIII of FIG. 12.
Figure 14:
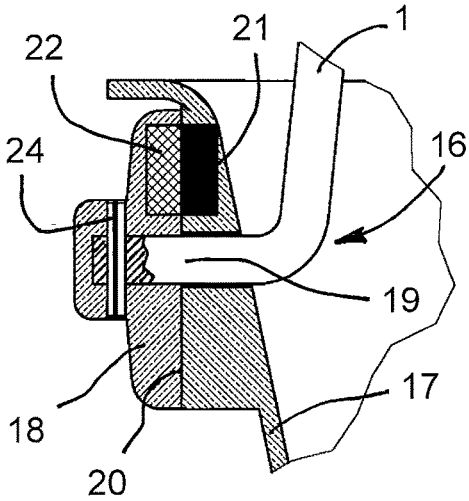
FIG. 14 is an enlarged schematic sectional view XIV of FIG. 13, limited to the magnets present in the positioning flange connected to the easy grip and arched handle and to the radial surface facing the flange.
Figure 15:
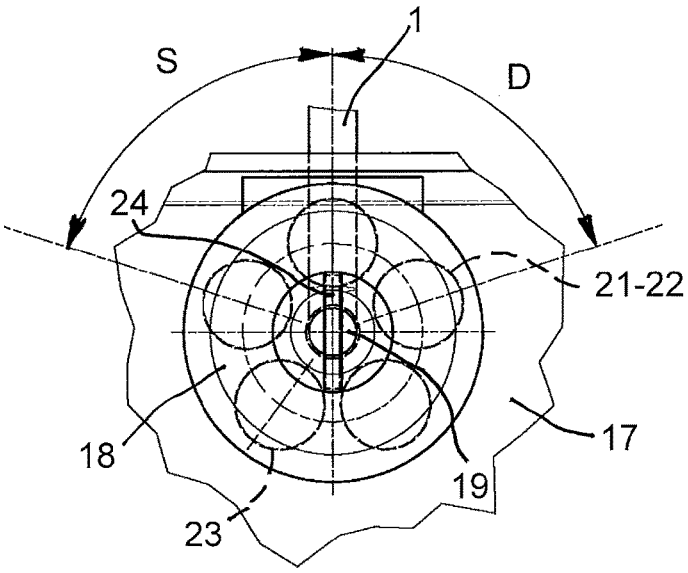
FIG. 15 is a schematic side and enlarged view of the angular position of the magnets in the hub of the easy grip and arched handle on the portable container of the preceding FIGS. 10-14, and/or in the same rotating positioning flange connected to the arched handle.
Figures 16, 17:
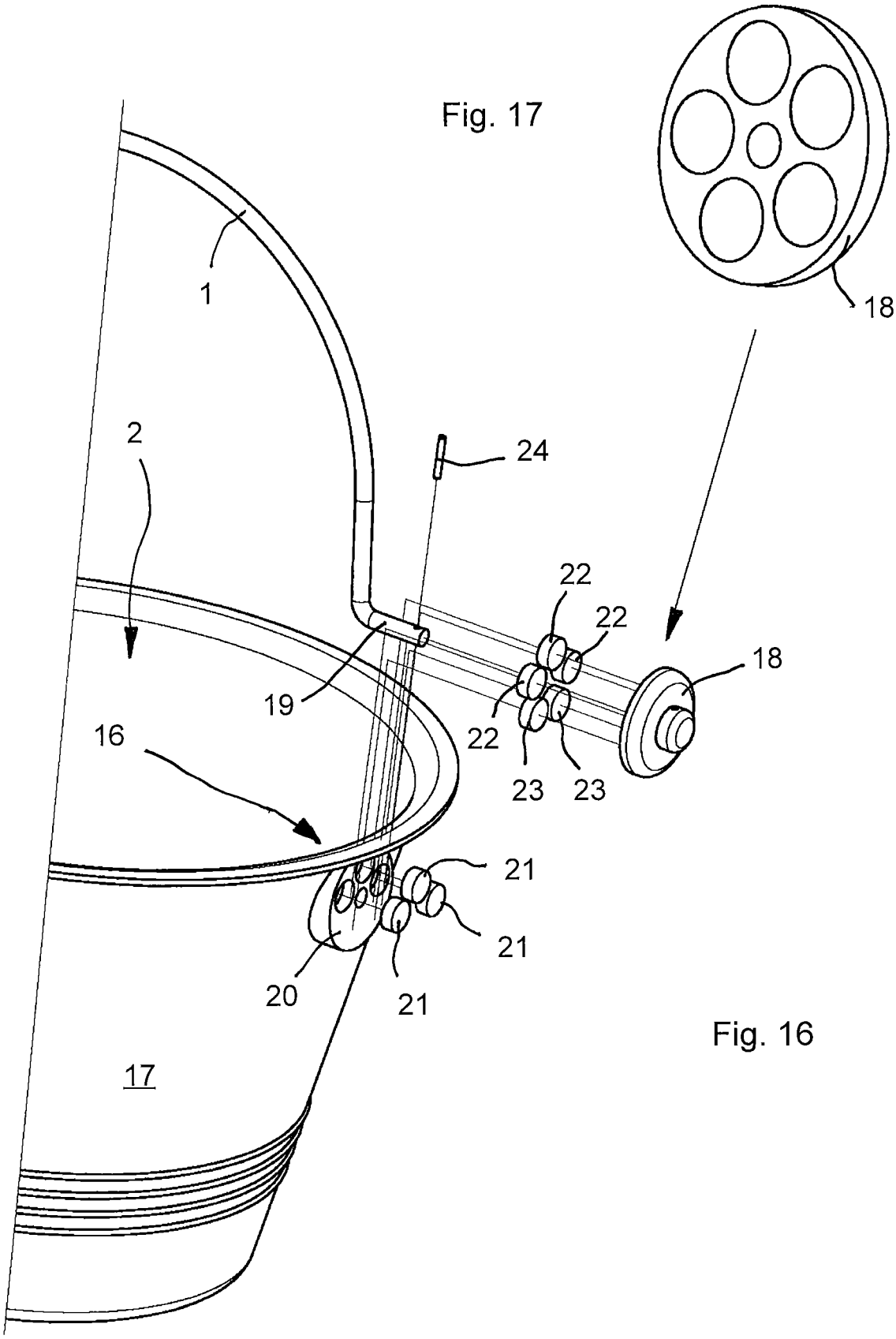
FIG. 16 represents a limited perspective schematic and exploded view of the components of the portable container of the preceding FIGS. 10-14, as applied to a mason's bucket which shows an application of said third constructive form of an easy grip handle for a portable container according to the invention.
FIG. 17 represents an enlarged schematic perspective view of the rotating positioning flange seen from the side of the surface facing the hub of the handle.

A third constructive form of an easy grip handle mounted on a portable container is shown in FIGS. 10 to 17, in which like parts have like numerals with respect to the preceding Figures. The easy grip and arched handle 1 is connected and rotates in the hinges 16 of the sides 17 of the portable container 2 together with a positioning means made here with a rotating flange 18 together with an end 19 of the easy grip and arched handle 1. The rotating flange 18 faces against a radial surface 20 with respect to the hinge 16 on which magnetic elements 21 are positioned inside a circle corresponding to the outer diameter of the rotating flange; said magnetic elements consist of separate permanent magnets or magnetized sectors of a single toroidal element. In the rotating flange 16 are housed, in the surface facing the radial surface 20, ferromagnetic elements 22 in a number equal to the magnetic elements 21 and identically equidistant in the arc of rotation possible for the easy grip and arched handle 1, plus two further ferromagnetic elements 23 of correspondingly equidistant ends. The connection between the rotating flange 18 and the end 19 of the easy grip and arched handle 1 can take place in the most convenient ways based on the material of the rotating flange 18, by interference fitting, fitting with a shaped end or even with a roll pin 24, as shown, in the appropriate matching holes on said end 19 and on the hub of the rotating flange 18.

As described, the ferromagnetic elements 22 are subject to the attraction of the magnetic elements 21 when the rotation of the easy grip and arched handle and rotating flange assembly determines the correspondence of a respective magnetic element 21, so that the handle maintains the reclined position on one side or, correspondingly, the position in which the easy grip and arched handle is almost vertical with respect to the container 2; the handle itself remains in the corresponding position due to the attraction of two or more magnetic elements on the corresponding two or more facing ferromagnetic elements. The positioning angle D, on the right, or S, on the left, with respect to the central average vertical position of the easy grip handle 1, can be the same or also different depending on the practicality of the grip required by the user of the container 2 on which the easy grip handle is made.

The use of the portable container on which an easy grip handle is made is obtained by simply moving the easy grip handle 1, rotating it within the respective hinges 4 or 16, allowing the handle itself to reach the position desired by the user, whether it is reclined on one or on the other side or almost vertical with respect to the container 2 itself. The action of attraction between the magnetic element 7, located at the end 6 of the positioning arm 5, and one of the ferromagnetic elements 8, stably positions the same handle in the first constructive form. In the same way, the second constructive form operates with the attraction between the end 11 of the positioning arm 10, which is ferromagnetic, and one of the magnetic elements 12, firmly housed in the respective raised seats 9, present in the side 3 of the container 2.

With the third constructive form, the position of the magnetic elements and of the ferromagnetic elements facing the radial surface 20 can be obtained in a different way from the one shown, that is by inserting not only three magnetic elements 21 in the seats, inserting a complete number of them corresponding to the number of ferromagnetic elements that must be attracted. In this way the applied attraction force is high, being realized on each correspondence between the magnetic element and the facing ferromagnetic element, and, therefore, the size of the magnetic elements can be reduced in proportion to the forces involved, to the mass of the easy grip handle and to the grip and displacement force, which the user applies to handle the easy grip handle itself when the container is empty, therefore not subject to the mass of its content.

The advantages in the use of a portable container in which an easy grip handle 1 is made according to any one of the described constructive forms are manifested in the practical use to which the container 2 is put. The user releases at any time the handle of the container and finds it in the same position in which it left it. Therefore, the position of the handle close to the vertical direction is certainly the most advantageous, being made stable and in a practical and simple way already during the construction of the container 2 itself.

Obviously, a person skilled in the art, in order to satisfy specific and contingent requirements, may make numerous modifications to a portable container in which an easy grip handle is made, as previously described, all however contained within the scope of protection of the present invention as defined by the following claims. Obviously, although less conveniently, the magnetic elements 21 and the ferromagnetic elements 22 in the third constructive form can be reversed in their position indifferently, i.e. housed in the rotating flange 18 or in the facing radial surface 20. Finally, although less conveniently, the magnetic elements can be present both in the rotating flange and in the facing radial surface, but organized with the facing polarity allowing the attraction and not the reciprocal repulsion in defining the foreseen positions of the easy grip handle in the container 2; in fact a permanent magnet is made of ferromagnetic material and has attraction or repulsion with other permanent magnets based on polarity. Furthermore, the container may have a squared shape and a positioning arm or flange operating with a hinge located outside the sides of the container 2.

The invention claimed is:

1. An easy grip handle and a portable container, the handle connected with a rotation hinge and rotatable to a reclined position at a side of the container and at least one raised position with respect to the container;

wherein the handle is maintained in each position by attraction elements defined by permanent magnets and ferromagnetic elements, the permanent magnets positioned close to the rotation hinge and located within in at least one of the handle and the container, the permanent magnets acting on the rotation of the handle by attraction with a corresponding one of the ferromagnetic elements positioned close to the rotation hinge in the other of the handle and the container, and at least two of the attraction elements stably inserted on the side of the container to support the gravity action force on the mass of the handle only to maintain, by magnetic attraction, at least one of said raised position and said reclined position of the handle.

2. The easy grip handle and portable container according to claim 1, wherein one of the permanent magnets is positioned at an end of a positioning arm fitted and rotating with the handle; the attraction elements in the side of the container are the ferromagnetic elements and the attraction elements maintain, by magnetic interaction, the raised position(s) of the handle on the portable container.

3. The easy grip handle and portable container according to claim 1, wherein the ferromagnetic elements are made with a positioning arm fitted and rotating with the handle; the attraction elements in the side of the container are the permanent magnet element and the attraction elements maintain, by magnetic interaction, the raised position(s) of the handle on the portable container.

4. The easy grip handle and portable container, according to claim 1, wherein the permanent magnet elements face a positioning flange, the positioning flange fitted and rotatable with the handle; the ferromagnetic elements are inserted in the rotating positioning flange, to define, through the magnetic interaction, the raised position(s) of the handle on the portable container.

5. The easy grip handle and portable container, according to claim 1, wherein there are several permanent magnet elements and correspondingly there are more ferromagnetic elements equal in number to the permanent magnet elements plus two ferromagnetic elements.

6. The easy grip handle and portable container according to claim 1, wherein the permanent magnet elements are arranged on a single magnetized toroidal element to form sections of different polarity, the toroidal element being on one side of the portable container; and the ferromagnetic elements are equal in number to the number sections of different polarity corresponding to the number of the permanent magnets on the single magnetized toroidal element that faces the ferromagnetic elements to thereby maintain, by means of the magnetic interaction, the raised position(s) of the handle on the portable container.

7. The easy grip handle and portable container, according to claim 1, wherein the permanent magnet elements are arranged on a single magnetized toroidal element to form sections of different polarity of the toroidal element, the toroidal element being on a rotatable flange of the handle; and the ferromagnetic elements are equal in number to the number sections of different polarity corresponding to the number of the permanent magnets on the single magnetized toroidal element that faces the ferromagnetic elements to thereby maintain, by means of the magnetic interaction, the raised position(s) of the handle on the portable container.

8. The easy grip handle and portable container, according to claim 1, wherein the permanent magnet elements are arranged on a magnetized toroidal element to form sections of the different polarity of the magnetized toroidal element, the magnetized toroidal element being disposed on a rotatable flange of the handle; and a magnetic toroidal element being disposed on one side of the container and facing the magnetized toroidal element, the magnetic toroidal element having an equal number of sections of different polarity corresponding to the number of permanent magnets of the magnetized toroidal element; the magnetized toroidal element and the magnetic toroidal element maintain, by means of the magnetic interaction, the raised position(s) of the handle on the portable container.

* * * * *